US009393809B2

(12) United States Patent
Lofftus

(10) Patent No.: US 9,393,809 B2
(45) **Date of Patent: *Jul. 19, 2016**

(54) INKJET PRINTING METHOD FOR PRINTING ON NON-POROUS MEDIA

(71) Applicant: Eastman Kodak Company, Rochester, NY (US)

(72) Inventor: Kevin D. Lofftus, Fairport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/315,685

(22) Filed: Jun. 26, 2014

(65) Prior Publication Data

US 2015/0375529 A1 Dec. 31, 2015

(51) Int. Cl.

| | |
|---|---|
| ***B41J 3/00*** | (2006.01) |
| ***B41J 2/39*** | (2006.01) |
| ***B41J 2/395*** | (2006.01) |
| ***B41J 11/00*** | (2006.01) |
| ***B41J 29/38*** | (2006.01) |
| ***B41J 3/54*** | (2006.01) |
| ***B41J 2/21*** | (2006.01) |
| *G03G 15/08* | (2006.01) |
| *B41J 2/01* | (2006.01) |

(52) U.S. Cl.

CPC ..... *B41J 11/002* (2013.01); *B41J 2/2114* (2013.01); *B41J 3/546* (2013.01); *B41J 11/0015* (2013.01); *B41J 29/38* (2013.01); *B41J 2/01* (2013.01); *G03G 15/08* (2013.01)

(58) Field of Classification Search

None

See application file for complete search history.

(56) References Cited

U.S. PATENT DOCUMENTS

| | | | | |
|---|---|---|---|---|
| 4,636,808 | A | 1/1987 | Herron | |
| 5,155,599 | A | 10/1992 | Delabastita | |
| 5,745,120 | A | 4/1998 | De Baer et al. | |
| 5,982,405 | A * | 11/1999 | Sasaki | B41J 2/325 347/176 |
| 6,140,390 | A | 10/2000 | Bugner et al. | |
| 6,588,888 | B2 | 7/2003 | Jeanmaire et al. | |
| 6,608,641 | B1 | 8/2003 | Alexandrovich et al. | |
| 6,753,051 | B1 | 6/2004 | Landry-Coltrain et al. | |
| 6,851,796 | B2 | 2/2005 | Jeanmaire et al. | |
| 7,335,407 | B2 | 2/2008 | Landry-Coltrain et al. | |
| 7,502,582 | B2 | 3/2009 | Ng et al. | |
| 7,830,569 | B2 | 11/2010 | Tai et al. | |
| 7,858,161 | B2 | 12/2010 | Nair et al. | |
| 8,298,634 | B2 | 10/2012 | Schroeder et al. | |
| 8,401,416 | B2 | 3/2013 | Tombs et al. | |
| 2005/0214004 | A1 * | 9/2005 | Toyohara et al. | 399/45 |
| 2010/0075240 | A1 * | 3/2010 | Akiyama et al. | 430/105 |
| 2013/0076828 | A1 | 3/2013 | Tombs et al. | |

(Continued)

*Primary Examiner* — Erica Lin

(74) *Attorney, Agent, or Firm* — Peyton C. Watkins; Nelson A. Blisa; David A. Novais

(57) ABSTRACT

An inkjet printing method for printing on a non-porous media includes pre-coating a smooth non-porous media with toner resin particles in a half-tone pattern to create a patterned toner coated media; applying inkjet ink to said half-tone patterned toner coated media to provide an image on said half-tone patterned toner coated media; wherein a tone value of the half-tone pattern is a pre-determined function of an image-wise lay-down of the inkjet image generated by a data processing system; and fusing said image on said toner coated media.

7 Claims, 4 Drawing Sheets

(56) References Cited

U.S. PATENT DOCUMENTS

2013/0127149 A1 5/2013 Tombs et al.
2013/0127964 A1 5/2013 Tombs et al.
2013/0129393 A1 5/2013 Tombs et al.
2013/0130172 A1 5/2013 Tombs et al.
2013/0162703 A1 6/2013 Tombs

* cited by examiner

INKJET PRINTING METHOD FOR PRINTING ON NON-POROUS MEDIA

CROSS REFERENCE TO RELATED APPLICATIONS

Reference is made to commonly assigned U.S. patent application Ser. No. 14/315,708 concurrently filed herewith by Kevin Lofftus et al., entitled "Hybrid Printer for Printing on Non-Porous Media."

FIELD OF THE INVENTION

The present invention relates to a method for printing on a non-porous medium which includes pre-coating the media with a toner in a half-tone pattern and then depositing ink on the patterned toner coated media to reduce ink coalescence.

BACKGROUND OF THE INVENTION

Inkjet printing is commonly used for printing on paper or other types of print media as ink receivers and is generally a non-contact application of an ink to the print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting either the print drops or non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

Inkjet printing with aqueous inks on smooth receivers (such as glossy clay coated lithographic paper stock) and non-porous receivers suffers from a well known quality problem known as ink coalescence. Non-porous is defined as a receiver that does not absorb freshly jetted ink deposits quickly enough into the receiver before the ink can dry thus permitting the undesirable effect of ink spreading and coalescencing into puddles. Text characters will have thin and thick areas of ink; this can resemble beads on a string. What is jetted as uniform density large solid areas will instead show macroscopic patterns of thin and thick ink deposits; the result can be described as either mottle or graininess depending on the spatial frequency of the coalescence. Additionally, ink of different colors that is not rapidly absorbed into the receiver may mix when jetted into adjacent areas resulting in image bleed.

A half-tone process is a well known dithering technique to reduce imaging instabilities of ink or toner deposition processes by dot area modulation of high deposition spots and areas of little or no deposition. The amount of deposition of toner or ink within the high deposition spots may also vary to produce a wide range of toner coverage or ink image densities. Inkjet dots are produced on a production print by discrete drops of ink and are typically limited to one or three drop sizes and to resolutions below 1200 dots per inch (DPI). These limitations prevent the use of half-tone dots in a regular pattern at a resolution pleasing to the eye. Instead, an error diffusion dithering processes must be used. A problem with error diffusion dithering images is that the image appears grainy. The grainy appearance may increase for color images as the error diffusion patterns in each color separation are over laid and increased image grain may be observed with an increasing number of color separations.

Certain inkjet printers can be adapted to produce high quality inkjet images (such as for proofing) by the use of multiple passes of imaging with high addressable ink printheads (4800 DPI) and inks having lower pigment or dye concentrations to overcome the grainy effect. To prevent the ink from coalescing, the ink vehicle, which may be water or a solvent, must partially be removed between imaging passes resulting in a slow imaging process. Smooth receivers such as clay coated paper are preferred for high quality inkjet images requiring long dry times between passes or expensive porous pre-coats to absorb the ink vehicle. Therefore, there is a need for a method of producing half-tone inkjet images in a single pass without a grainy appearance.

U.S. Pat. No. 6,140,390A, U.S. Pat. No. 6,753,051B1, U.S. Pat. No. 7,335,407B2, U.S. Pat. No. 7,858,161B2, and U.S. Pat. No. 8,298,634B2, all incorporated herein by reference, include inkjet receiving layers comprising polymeric particles and other ingredients, which are coated onto receiver base stock via liquid based coating processes. Such receivers must be manufactured via large scale controlled and complex industrial operations. There is a need for a pre-coat process that can be accomplished in the actual inkjet printer. There is also a need for a pre-coat process that can be utilized on any type of receiver, without having to purchase a specialty coated stock as described in these references.

U.S. Patent Publications US20130162703(A1), US20130130172(A1), US20130127964(A1), US20130127149(A1), and US20130129393(A1), all incorporated herein by reference, describe dry polymeric particle pre-coating processes for inkjet printing, that do solve some of the problems in the previously described prior art. These US Publications teach combining clear toner and inkjet ink to facilitate de-inking. None of these references teach changing the micro-structure of the toner lay-down to prevent coalescence nor do they teach using micro-structure patterns to improve image quality.

A known problem with printing using half-tone patterns results when using an imaging process having more than three color separations and optionally black, also known has hi-fidelity color rendering (U.S. Pat. No. 5,155,599 and U.S. Pat.

No. 5,745,120) is the generation of objectionable Moiré interference patterns known in the art as Moiré. As the number of color separations in the image increases, the choice of half-tone screen patterns becomes limited. For more than three color separations, a different line frequency may be required and not all color separations are printed at the optimal screen frequency. There is a need to be able to print a large number of color separations without being limited by Moiré.

Although satisfactory, there is a need to improve upon these disclosures. The present invention improves upon these disclosures by applying the polymeric particles in a half-tone pattern, the tone value of which is dependent on the density of the image to be inkjet printed in order to achieve optimal image quality.

SUMMARY OF THE INVENTION

K1016

The present invention relates to an inkjet printing method for printing on a smooth non-porous media comprising pre-coating a smooth non-porous media with toner resin particles in a half-tone pattern to create a patterned toner coated media; applying inkjet ink to said half-tone patterned toner coated media to provide an image on said half-tone patterned toner coated media; wherein a tone value of the half-tone pattern is a pre-determined function of an image-wise lay-down of the inkjet image generated by a data processing system; and fusing said image on said toner coated media.

DETAILED DESCRIPTION OF THE INVENTION

Figure 1:
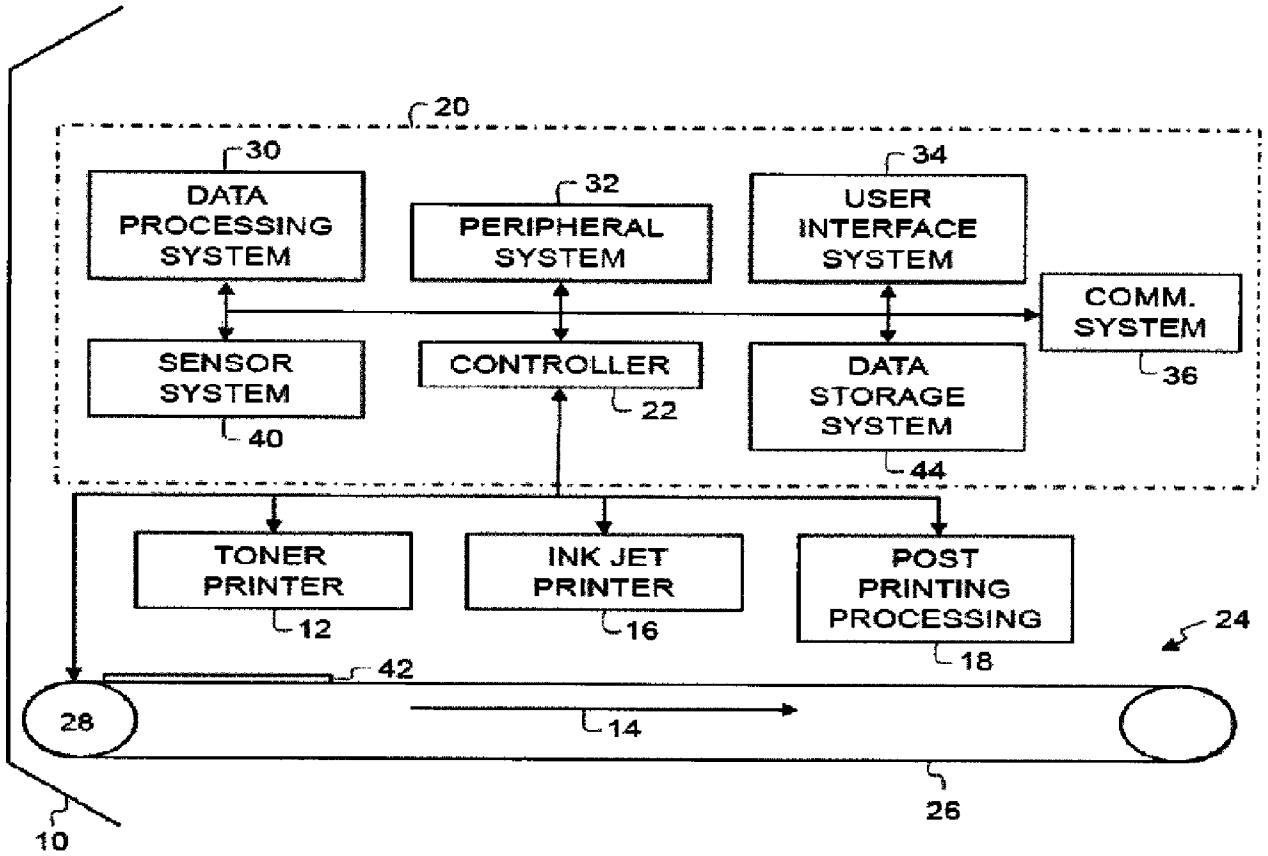
FIG. 1 schematically shows a printing system in accordance with the present invention.

Referring now to the drawings, wherein like reference numerals represent similar or identical parts throughout the several views, FIG. 1 shows a system level view of one embodiment of a printing system 10 having a toner printer 12 and an inkjet printer 16. The printing system 10 has a control system 20 that controls and integrates the operation of toner printer 12 and inkjet printer 16, and a transport system 24 shown as an endless transport belt 26 that connects toner printer 12 and inkjet printer 16.

In operation, control system 20 causes an actuator 28 such as a motor (not shown) in transport system 24 to move the endless transport belt 26 so as to advance a medium 42 in a printing direction 14 past toner printer 12 and inkjet printer 16. Within the context of the present invention, the medium 42 may be smooth and non-porous (such as glossy clay coated lithographic paper stock) on which an inkjet ink and toner image can be processed using the methods that are described herein. In the embodiments that follow, the medium 42 is shown in a sheet form; however, continuous web types of medium 42 may also be used.

Although shown as a single endless transport belt 26 in FIG. 1, it will be appreciated that, in other embodiments, transport system 24 can comprise any type of system that can move the media 42 from toner printer 12 to inkjet printer 16 in a manner that allows the toner printer 12 to pre-coat the medium 42 with particulate resin particles of the appropriate physical properties and that allows the inkjet printer 16 to form an inkjet image on the coated medium 42. The transport system 24 also provides a mechanism for moving the medium 42 past an optional post printing processing system 18. The optional post processing system 18 may include, but is not limited to, fusing systems, cutting systems, folding systems, binding systems, glossing and drying systems.

The control system 20 has a controller 22 that is communicatively connected with a data processing system 30, a peripheral system 32, a user interface system 34, and a communication system 36, a sensor system 40 and a data storage system 44. The sensor system 40 may include a sensor (integral with or remotely associated with) that is adapted to sense the type of receiver in the print path. An example of a sensor system 40 is a light source and a photo diode capable of detecting transmitted light for transparent receivers such as those made from polymer films when the receiver passes between the light source and the photodiode. In another example, the photo diode may be placed on the same side of the medium 42 as the light source with a set angle between the source and the diode to detect gloss receivers. In yet another example, the sensor system 40 is capable of detecting surface conductivity and may be used to detect metal media 42.

The controller 22 may include any form of control circuit or system that can perform any of the functions or cause any other component of the printing system 10 to perform of the functions described herein. In this regard, the controller 22 can include a microprocessor incorporating suitable look-up tables and control software executable by the controller 22. The controller 22 can also include a field-programmable gate array (FPGA), programmable logic device (PLD), microcontroller, or any other control system or systems capable of performing the functions described or claimed herein.

A data processing system 30 includes one or more data processing devices that implement the processes of various embodiments, including the example processes described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise.

In one embodiment, the data processing system 30 may include a digital front-end processor (DFE). The DFE uses image data and production information to form image data for printing such as rasterized bitmaps or other image types and printing instructions that can be used by toner printer 12 or inkjet printer 16 to determine, respectively, how much toner and ink to deposit at specific locations on the medium 42 and to determine any required post-processing operations to be performed after toner and inkjet printing. The data processing system 30 can also include a color management system that uses known characteristics of the image printing process implemented in the printing system 10 to provide known, consistent color reproduction characteristics for various types of input (e.g. digital camera images, film images and computer generated images).

A peripheral system 32 can include one or more devices configured to provide print order data or components thereof such as image data to the controller 22 and to data processing system 30. For example, the peripheral system 32 can include digital still cameras, digital video cameras, cellular phones, or other data processors, digital front ends, graphic image servers or computing devices or any other devices that can provide image data and printing instructions to the control system 20. The data processing system 30, upon receipt of print order data from a device in the peripheral system 32, may store such print order data in a data storage system 44.

A user interface system 34 can include a mouse, a keyboard, a touch screen, another computer, or any device or combination of devices that can determine when a user has made a user input action and that can convert this user input action into data or other signals that can be used by the controller 22, the data processing system 30 or any other component of the control system 20 in operating the printing system 10. In this regard, although the peripheral system 32 is shown separately from the user interface system 34, the peripheral system 32 may be included as part of the user interface system 34.

The user interface system 34 also may also include a display device, a processor-accessible memory, or any device or combination of devices allowing the control system 20 to provide output signals to a user of printing system 10. In this regard, if the user interface system 34 includes a processor-accessible memory, such memory can be part of the data storage system 44 even though the user interface system 34 and the data storage system 44 are shown separately in FIG. 1.

The data storage system 44 includes one or more processor-accessible memories configured to store information, including the information needed to execute the processes of the various embodiments, including the example processes described herein.

The data storage system 44 can be a distributed processor-accessible memory system including multiple processor-accessible memories communicatively connected to data processing system 30 via a plurality of computers or devices. On the other hand, the data storage system 44 need not be a distributed processor-accessible memory system and, consequently, can include one or more processor-accessible memories located within a single data processor or device. The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, solid state or semi-conductor Read Only Memory (ROM), and solid state or semi-conductor Random Access Memory (RAM).

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors at all. In this regard, although the data storage system 44 is shown separately from data processing system 30, one skilled in the art will appreciate that the data storage system 44 can be partially or completely incorporated with the data processing system 30. Further, although the peripheral system 32 and the user interface system 34 are shown separately from the data processing system 30, one skilled in the art will appreciate that one or both of such systems can be partially or completely within the data processing system 30.

The control system 20 uses print order data and production information to determine what image is to be printed by the inkjet printer 16 and what toner pre-coat half-tone pattern is required by toner printer 12 when requested or necessitated by the use of the medium 42 of the smooth non-porous type. The data processing system 30 may determine the half-tone pattern of the clear toner deposit by the use of a functional relationship between the tone value and the image-wise lay-down of the inkjet image or by use of a look-up table that references the image-wise lay-down of the inkjet image. The processor may modify the half-tone pattern for media type. The data processing system 30 may have a processor that detects image edges and boundaries between colors and modifies the tone value accordingly. Further, the data processing system 30 is used to help convert source image information into machine image information. In particular, data processing system 30 can include a dedicated image processor or raster image processor (RIP; not shown), which can include a color separation screen generator or generators or a general purpose processor that is adapted to perform raster image processing and other processing described herein.

The term tone value when applied to the processor and the toner printing module normally refers to the apparent image density that would be produced by a half-tone patterned lay-down of pigmented toner. In the case of the toner lay-down used in the present system, which may be done using clear toner, the term tone value specifically refers to the % dot coverage in the half-tone pattern that would have resulted in a visible tone if using pigmented toner. Thus, tone value is synonymous with terms like % lay-down or half-tone coverage when applied to a half-tone pattern. Additional parameters that more fully define the half-tone pattern include the screen frequency and the screen angle. All of these parameters can be determined by the image processor and produced on the medium 42 by the toner printer 12.

The control system 20 is illustrated as being apart from toner printer 12 and inkjet printer 16. However, this is for the purpose of illustration only and it will be understood that in general, any components of control system 20 or any functions that are described as being performed by control system 20 can be located in or performed by components that are located in whole or in part in toner printer 12 or inkjet printer 16 or in other process and control devices normally used therewith such as a digital front end or a print server.

The toner printer 12 can be any device that can create a pattern of particles of toner on the medium 42. In general, the toner is composed of dry toner particles containing a polymeric binder such as polyester or polystyrene and may contain charge agents to impart a specific toner charge, colorants, sub-micrometer particulate addenda particles such as various forms of hydrophobic silica, titanium dioxide, and strontium titanate on the surface of the toner to further control toner charge, enhance flow, and decrease adhesion and cohesion. The colorant is generally a pigment but could be a dye. The toner particles used in conventional electrophotographic printers have a diameter between approximately 5 μm and 9 μm and are made by either grinding or by chemical process means such as evaporative limited coalescence (ELC), as are known in the literature. However, larger sized toners in the range for example of about 12 micrometers to about 30 micrometers or large may be used. As used herein, unless otherwise specified, the terms toner diameter and toner size refer to the volume weighted median particle diameter, as measured using a commercial device such as a Coulter Multisizer.

Within the context of the present invention, the toner printer 12 is adapted to deposit a clear toner on medium 42 prior to printing by the inkjet printer 16 in a manner in which a specific proportion of the receiver surface is coated with clear toner and can be a Kodak NexPress electrophotographic printer. In known electrophotographic printers, this clear toner can be applied by an imaging module that is adapted to apply clear toner. The clear toner uses particles that are similar to the toner particles of color development stations but without colored material (e.g. dye or pigment) incorporated into the toner particles. In one example of such clear toner, the optical transmission density of a monolayer of clear toner after fusing can be less that about 0.05 for white light. However, a clear-toner overcoat can add cost and reduce color gamut of the print; thus, it is desirable to provide for operator/user selection to determine whether or not a clear-toner overcoat will be applied to a print. In the present invention, the pre-coating with clear toner is performed at least when smooth non-porous receiver is used; for example selected by a user or detected by the sensor (not shown). Further details regarding the toner print engines and related components are provided in U.S. Pat. No. 6,608,641, issued on Aug. 19, 2003, to Peter S. Alexandrovich et al., in U.S. Pat. No. 7,502,582, issued on Mar. 10, 2009, by Yee S. Ng et al. and U.S. Pat. No. 8,401,416, issued on Mar. 19, 2013 to Thomas N. Tombs et al., all of which are incorporated herein by reference.

Figure 2:
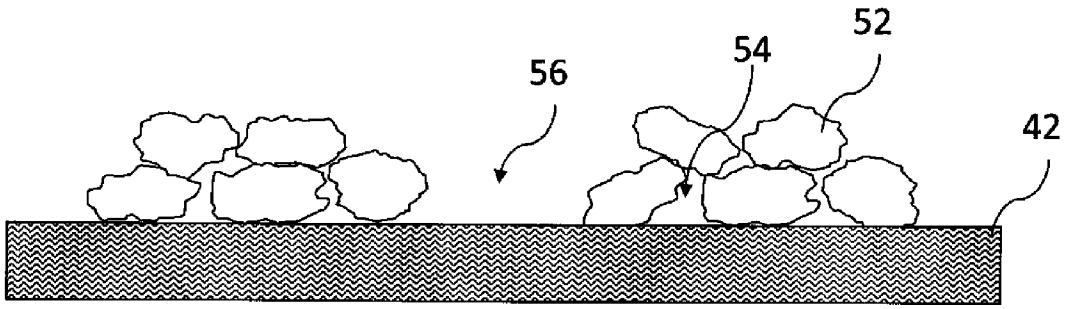
FIG. 2 is an illustration of the clear toner before the deposition of ink.
Figure 3:
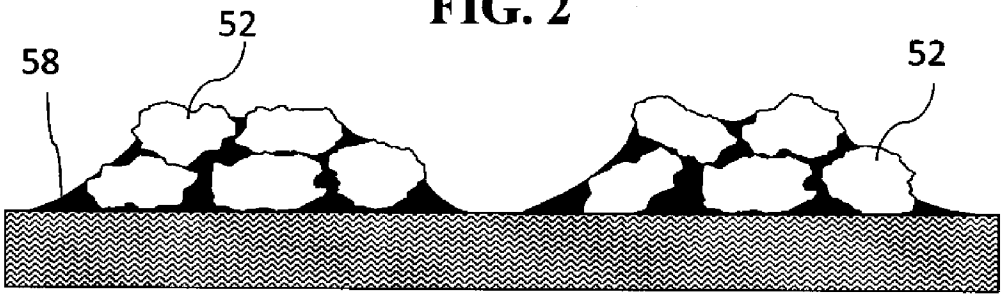
FIG. 3 is an illustration of the clear toner after the deposition of ink.
Figure 4:
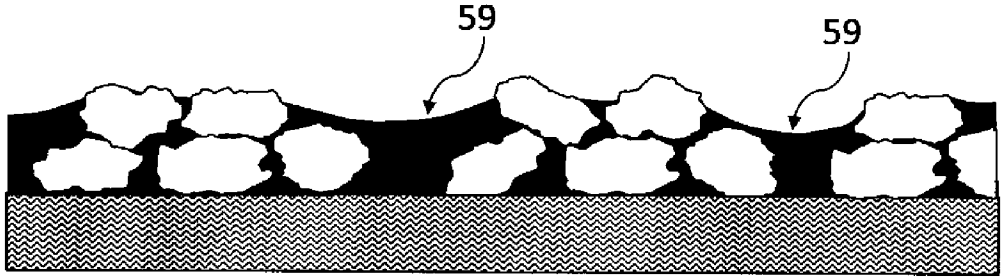
FIG. 4 is also an illustration of the clear toner after the deposition of ink further illustrating the ink in the meniscus.

The pre-coat of clear toner on the medium 42 is deposited in a regular half-tone pattern at resolutions pleasing to the eye. The half-tone process is a well known technique to improve the image stability of ink or toner deposition amounts by dot area modulation of higher deposition spots and areas of little or no deposition. The deposition of toner or ink within the dot may also vary to produce a wide range of image densities. It has been found that a pre-coat of clear toner deposited in a half-tone pattern before ink jetting induces a regular pattern in inkjet images at resolutions that are pleasing to the eye. Referring to FIG. 2, it illustrates the medium 42 having clear toner particles 52, having spaces 54 between the clear toner particles 52 before the deposition of ink, and spaces 56 between the half-tone dots of clear toner particles 52. FIGS. 3 and 4 illustrate the image after ink 58 is deposited on the clear toner particles 52. The ink 58 may be held in both the spaces 54 between clear toner particles 52 as shown in FIG. 3 as well as in the meniscus 59 around and between half-tone dots of clear toner in the half-tone pattern as shown in FIG. 4. The induced half-tone pattern 64 (FIG. 5) in the inkjet image is created when the ink pigment or dye is concentrated in the meniscuses 59 between the clear toner particle half-tone dots as the ink vehicle (water, solvent) is removed resulting in an induced half-tone pattern in the inkjet image. When the half-tone pattern of clear toner is printed on porous media that absorbs the ink 58, less ink colorant (pigment or dye) is absorbed into the pattern reducing and possibly eliminating the induced half-tone pattern.

Figure 5:
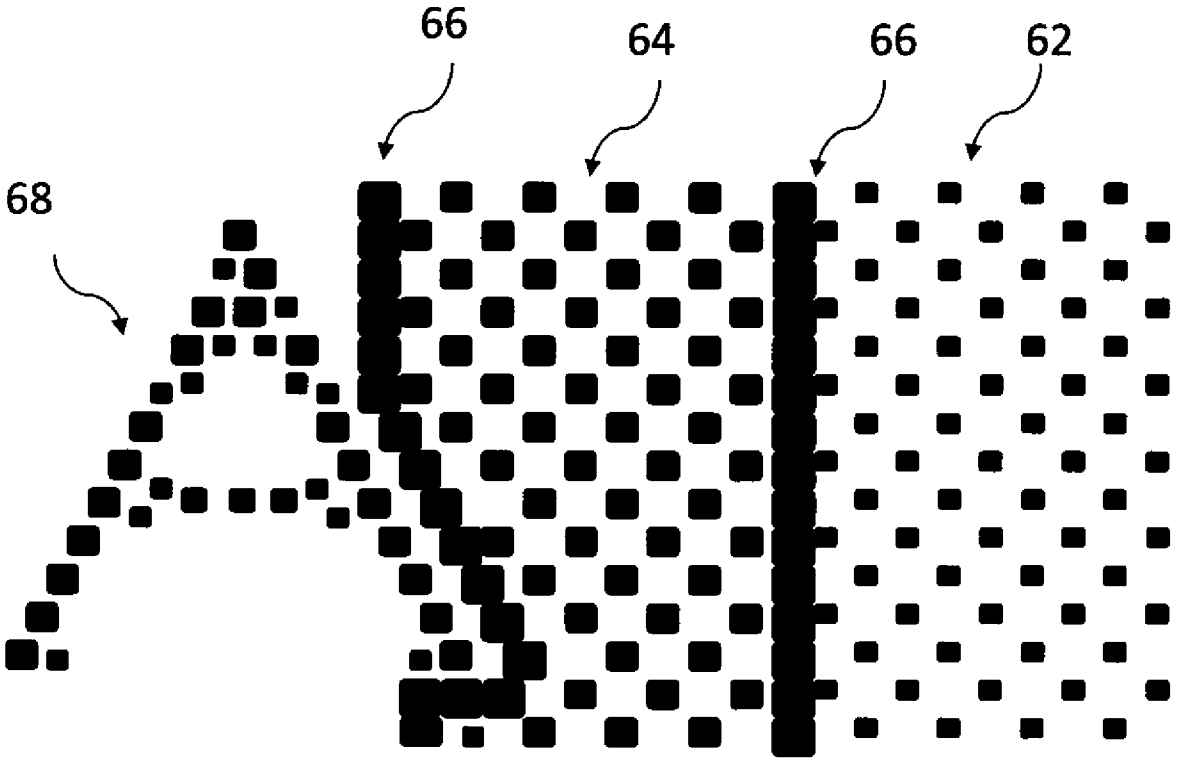
FIG. 5 is an illustration of half-tone patterns and edge lay-downs for the clear toner.

The half-tone deposit of clear toner provides a surface texture on the medium 42 in which the ink 58 from the inkjet printer 16 is held by capillary forces and prevented from moving laterally across the medium 42. Typically, the toner deposited in the half-tone dots is multilayered. The dots may be printed in isolation to prevent wicking between dots for low and moderate ink lay-down. The volume of ink 58 contained within the surface texture provided by the half-tone deposits of clear toner is the volume of the meniscuses 59 between the dots plus the volume of spaces 56 between the toners. When the volume of the applied ink 58 exceeds that of the surface texture, the ink 58 may displace the clear toner particles 52 eliminating the capillary forces that prevent ink coalescence. More ink 58 may be held between half-tone dots when the meniscus 59 bridges the dots. The volume of the bridged meniscuses 59 decrease as the half-tone value is increased to that of full receiver coverage by the clear toner particles 52. At high ink lay-down values, the volume of ink 58 contained within the bridged meniscuses 59 may be less than that of the applied inkjet ink leading to image bleed. The volume in which the ink 58 is held may be increased by reducing the half-tone value without decreasing the height of the dot created by the clear toner or by increasing the amount of toner applied at each half-tone value so that the height of the dot is increased. Much of the medium 42 must be covered by toner to obtain high image densities at high ink lay-down and it is not possible to create the half-tone dots of clear toner in isolation to prevent image bleed. Thus it is desirable to have clear toner deposits at different half-tone values for different inkjet ink lay-down, as is illustrated in FIG. 5. The data processing system 30 can provide half-tone images with different half-tone patterns 62 and 64 of toner deposits to match the ink lay-down whereby the half-tone image is printed by the toner printer 12 in registration to the image printed by inkjet printer 16. The data processing system 30 detects image edges and boundaries 66 between colors and modifies the tone value of the toner half-tone pattern 62, 64 accordingly. An image edge is a boundary where the image changes suddenly from one color to second color. The second color may be that of the medium 42 where there is no ink 58. In this case, the half-tone dots of clear toner create a ragged edge that may be smoothed by modifying the center position of the dots on the edge by any algorithm such as the Voronoi algorithm disclosed in by Tai in U.S. Pat. No. 7,830,569B2. An additional embodiment of this function can provide varying half-tone patterns as dictated by the ink lay-down within a text character 68 in FIG. 5. In another embodiment, the ink 58 of the inkjet image may be held at the edge or boundary 66 by high tone value dots of clear toner or a continuous line of clear toner. The later method is preferred for image edges between colors to prevent color bleed wherein the said second color is produce by ink 58.

The pre-coat of clear toner on the medium 42 may be deposited in a regular half-tone pattern in a single imaging pass to induce a half-tone pattern in an inkjet image using an inkjet imaging process having more than three color separations and optionally black thus avoiding objectionable Moiré. A distinct advantage of a pre-coat layer with a half-tone pattern that induces a half-tone pattern in the ink image is that only one screen is present, thus eliminating the possibility of visible Moiré that are undesirable in the printed image. As the number of color separations in the image increases, the choice of screen patterns becomes limited. For more than three color separations, a different line frequency may be required and not all color separations are printed at the optimal screen frequency. In the context of the present invention, the number of color separations present in the inkjet limit is not limited by Moiré.

The inkjet printer 16 forms images on the pre-coated medium 42 using an inkjet print engine and can include a drop-on-demand printhead, either thermal or piezoelectric, or a continuous printhead, using gas, electrostatic, or other deflection methods. As an example, the inkjet printer can be a Kodak ESP Office™ printer 2150. Further details of inkjet marking engines are found in U.S. Publication 2013/0076828, published Mar. 28, 2013, U.S. Pat. Nos. 6,588,888, 4,636,808, and 6,851,796, all of which are incorporated herein by reference.

In other embodiments, the inkjet print engine for the inkjet printer 16 can use piezoelectric drop-on-demand systems where current is provided to a piezoelectric actuator to cause the actuator to deflect and push an ink drop out of ink manifold. In still other embodiments continuous-inkjet systems can pressurize the ink 58 in the ink manifold to cause a filament of ink 58 to flow from the nozzle and break the filament into drops in a controlled manner, e.g., by selectively heating the ink stream in an appropriate timing sequence. The drops are then selectively directed along a printing path to a guttering system or to form dots on the medium 42.

As shown in FIG. 1, optional post printing processing system 18 can be provided. The optional post printing processing system 18 can include a fusing system that fuses the printed image to the medium 42 through the use of heat and pressure. In various embodiments, the optional post printing processing system 18 can provide additional finishing systems such as those that are known in the art for handling media-handling operations, such as folding, stapling, saddle-stitching, collating, and binding.

Figure 6:
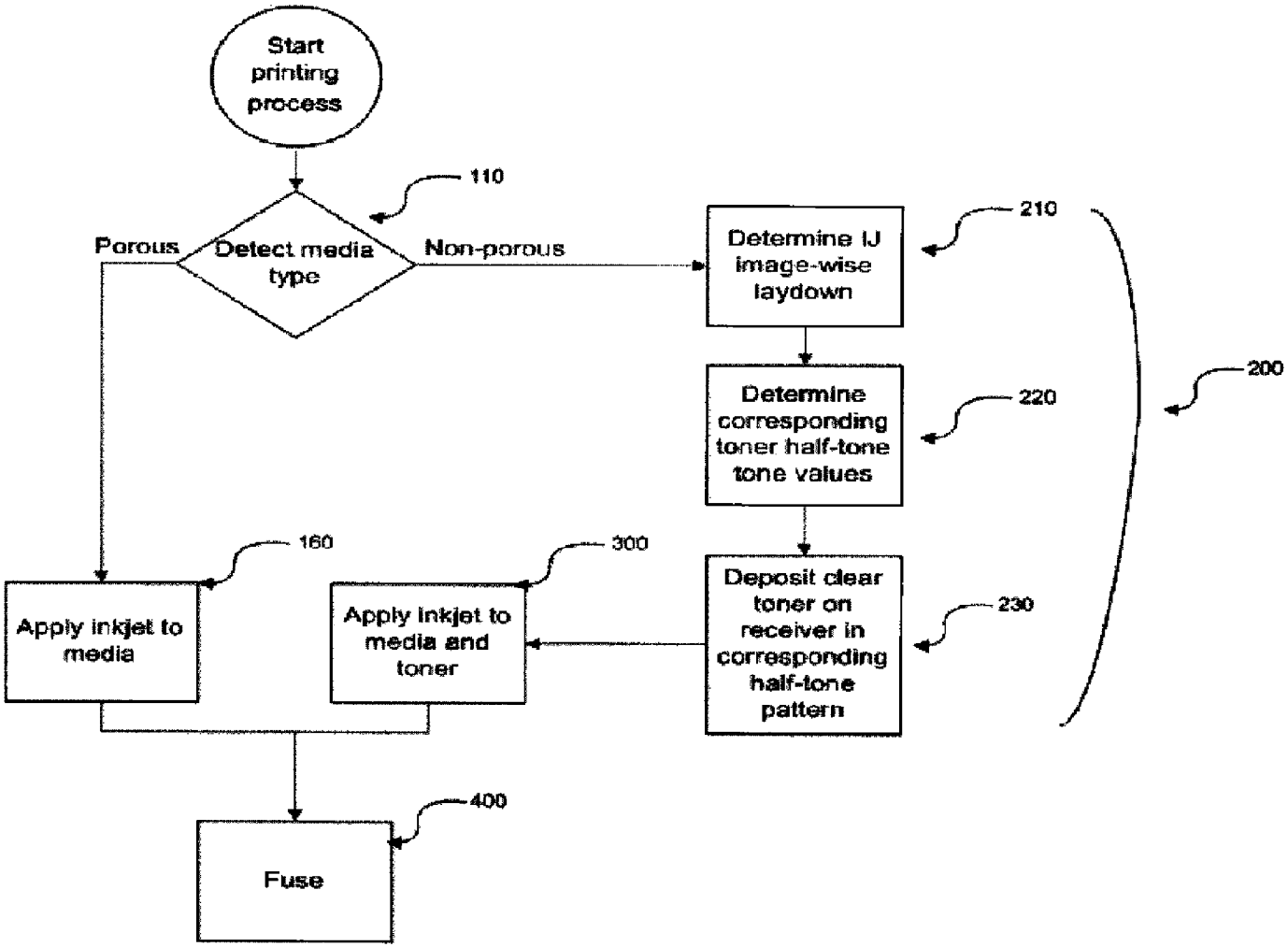
FIG. 6 is a flow chart on the method of the present invention.

FIG. 6 shows a flow chart detailing a method in accordance with the present invention. The first step of the printing process is to detect the media type 110 to determine if it is of a porous character (typically rough, low gloss) or of a non-porous character (typically smooth, glossy). This can be through either the use of the sensor or by selection by the user. If printing is to be performed on porous media, the printing system 10 can be used in a basic mode where the printing step of applying inkjet 160 to the medium 42 is through the use of the inkjet printer 16. Where printing is to be performed on smooth non-porous media by virtue of detection by sensor or selection by a user, the method of the present invention includes a set of steps 200 of pre-coating at least 10% of a surface of the smooth non-porous media 42 with toner resin particles applied by toner printer 12 to create a toner coated media. This is done by first determining or mapping the image-wise ink lay-down for the ink jet image (step 210). Then the data processing system 30 determines the corresponding half-tone tone values required and creates a map for the toner deposition on the receiver (step 220). Finally, the toner printer 12 deposits the clear toner in the specified half-tone pattern and locations on the receiver (step 230). Thereafter, the toner coated media is conveyed by the endless transport belt 26 to the inkjet printer 16 where aqueous inkjet ink 58 is applied to the toner coated media (step 300) to provide for an image on said toner coated media. The toner coated media with the inkjet image thereon can then by conveyed by way of the endless transport belt 26 to the optional post printing processing system 18 which can include a fuser to fuse the image on the toner coated media (step 400).

Within the context of the present invention, the toner resin particles are preferably clear toner particles and have a size of between 6 μm and 21 μm.

INVENTION EXAMPLES

In a first invention example, a clear toner approximately 6 μm in size and with a particulate surface treatment comprising a first silicone treated silica and a second silane treated silica was printed using a NexPress 2500™ printer on Lustro Laser Gloss receiver was deposited using 100, 141, and 212 LPI (lines per inch) hard dot (all the 600 dpi pixels in the dot had nearly the same exposure level) at 45 degrees to the imaging direction at half-tone values at 15%, 30%, 50%, 70%, 85%, and 100% tone values at approximately 4.5 gsm, 6.5 gsm and 8.5 gsm for 100% tone value. A Kodak ESP™ Office printer 2150 aqueous inkjet printer was used to print both large solid areas and text characters of various colors. The character A was evaluated at a single ink color level of cyan, a higher ink level of blue, and an inverse character surrounded by a field of black, and 12 mm by 12 mm adjacent areas printed in the order cyan, magenta, yellow, black, red, green, and blue. The ink colorant (pigment or dye) was concentrated in the toner containing dots resulting in a screen pattern observable under a loupe. It was found that coalescence was reduced in all test images and only readily visible 212 LPI 15% tone value at 4.5 gsm. The dots of toner in half-tone patterns were connected for tone values of 50% and high causing image bleed when insufficient volume of ink could be held by the dot. Increased tone value and toner coverage reduced the bleed increased the volume of ink held by the dot and reduced the bleed between colors. Tone values of 30% resulted in the best half-tone pattern and low bleed between colors, equivalent to 100% tone value. Thereafter the printed images were fused and it is possible to vary the gloss of the images by varying fusing conditions such as nip width, temperature, speed and pressure. The act of fusing also raised the density of the images.

In a second invention example, a clear toner approximately 6 μm in size and have a silicone treated silica particulate surface treatment was deposited at approximately 4.5 gsm and 7.5 gsm for 100% tone value using half-tone values at 6%, 9%, 12%, 15%, 18%, 22% and 26% half-tone values. Higher half-tone tints were found to encourage dot-to-dot wicking resulting in objectionable image artifacts. The character A was evaluated at a single ink color level of cyan and at a higher ink level of blue. Dots in core of the character were disrupted when the volume of ink exceeded the combined volume of the space between toner particles in the dot and the volume between the dots defined by the dot height. This occurred for cyan characters at half-tone values below 9% at 4.5 gsm and 6% at 7.5 gsm and for blue characters at half-tone values below 26% for 4.5 gsm and 22% for 7.5 gsm. As the half-tone value was reduced from 26% to 15%, the dot height not reduced and the combined volume increased and stable blue characters were printed at half-tone values of 15% and 12%.

In a comparative example, the 6 μm sized clear toner in second invention example was printed in a continuous manner on Lustro Laser Gloss receiver. The toner deposits were deposited in a continuous tone manner across the full width of the receiver at approximately 0.27, 0.83, 1.4, 2.6, 3.3, 4.5, 5.6 and 7.5 gsm respectively.

In this comparative example, it was observed that as the toner coverage increased coalescence was eliminated. Coalescence was judged to be acceptable at about 0.83 gsm or higher coverage. However, at high toner coverage the text characters in particular showed lateral spread of the ink; where ink wicks out of the character into the toner deposit outside of image areas. This phenomenon was visible at a toner coverage greater than 8.3 gsm. Thus, it was possible to achieve both low coalescence and good text character at a single toner coverage. However, no half-tone pattern was present to reduce the visibility of non-uniformities in the inkjet image.

The present invention has been described in detail with particular reference to certain preferred embodiments thereof, but it will be understood that variations and modifications can be effected within the spirit and scope of the invention.

PARTS LIST

10 printing system
12 toner printer
14 printing direction
16 inkjet printer
18 optional post printing processing
20 control system
22 controller
24 transport system
26 endless transport belt

28 actuator
30 data processing system
32 peripheral system
34 user interface system
36 communication system
40 sensor system
42 medium
44 data storage system
52 clear toner particles
54 spaces between clear toner particles
56 spaces between half-tone dots
58 ink
59 meniscus
62 half-tone pattern
64 half-tone pattern
66 edges and boundaries
68 text character
110 detect media type
120 pre-coat media
160 applying ink to media
200 set of steps
210 determine IJ image-wise lay-down
220 determine corresponding toner half-tone tone values
230 deposit clear toner
300 applying ink to media
400 fuse

The invention claimed is:

1. An inkjet printing method for printing on a non-porous medium comprising:

pre-coating a non-porous medium with toner resin particles in a half-tone pattern to create a patterned toner coated medium, wherein a tone value of the half-tone pattern is a pre-determined function of an image-wise lay-down of an inkjet image generated by a data processing system;

applying inkjet ink to said half-tone patterned toner coated medium to provide the inkjet image on said half-tone patterned toner coated media; and fusing said image on said toner coated medium.

2. The method according to claim 1, wherein said toner resin particles are clear toner particles.

3. The method according to claim 1, wherein said toner resin particles have a size of between 6 μm and 21 μm.

4. The method according to claim 1, wherein the tone value of the half-tone pattern is determined by a calculation by the processor that uses a functional relationship between the tone value and the image-wise lay-down of the inkjet image.

5. The method according to claim 4 wherein the tone value is modified for medium type.

6. The method according to claim 4, wherein said toner resin particles are clear toner particles.

7. The method according to claim 4, wherein said toner resin particle particles have a size of between 6 μm and 21 μm.

* * * * *